US005690517A

United States Patent [19]

Betsui

[11] Patent Number: 5,690,517

[45] Date of Patent: Nov. 25, 1997

[54] RECEPTACLE CONTACT

[75] Inventor: Kazuhisa Betsui, Yokohama, Japan

[73] Assignee: The Whitaker Corporation, Wilmington, Del.

[21] Appl. No.: 754,115

[22] Filed: Nov. 21, 1996

Related U.S. Application Data

[63] Continuation of Ser. No. 378,854, Jan. 25, 1995, abandoned.

[30] Foreign Application Priority Data

Mar. 31, 1994 [JP] Japan ..... 6-085609

[51] Int. Cl.[6] ..... H01R 4/48

[52] U.S. Cl. ..... 439/839; 439/843; 439/850

[58] Field of Search ..... 439/833, 839, 439/842, 843, 849, 850, 851

[56] References Cited

U.S. PATENT DOCUMENTS 4,699,444 10/1987 Isohata ..... 439/839

5,281,175 1/1994 Chupak et al. ..... 439/839

5,362,262 11/1994 Hotea ..... 439/839

FOREIGN PATENT DOCUMENTS 58-62564 4/1983 Japan .

*Primary Examiner*—J. J. Swann

[57] ABSTRACT

A receptacle contact 10 is made by stamping a blank from a metal sheet and forming it to a final configuration. The receptacle contact 10 has a box-like tab receiving cavity section 11 intended for receiving a mating tab contact. The cavity section 11 has a spring-loaded contacting arm 23 which makes electric contact with the mating tab contact, and a protective wall 24 which covers the spring-loaded contacting arm 23 almost completely, except for a contacting section 26. This makes it possible to prevent a spring section 25 of the spring-loaded contacting arm 23 from interference with tab contacts which are not inserted straight or with other objects inserted in the tab receiving cavity section, thus preventing damage to the contacting arm 23.

11 Claims, 1 Drawing Sheet

RECEPTACLE CONTACT

This application is a Continuation of application Ser. No. 08/378,854 filed Jan. 25, 1995, now abandoned.

FIELD OF THE INVENTION

This invention relates to a receptacle contact for electrical connection to a mating tab contact by means of a spring-loaded contacting arm, where the contact has an improved design for the purposes of protection of the spring-loaded contacting arm from deformation or damage.

BACKGROUND OF THE INVENTION

Japanese Utility Model Publication No. 83-62564 describes a receptacle contact having a spring-loaded contacting arm which forms a spring-loaded connection with a mating tab contact. The spring-loaded contacting arm of this type extends lengthwise from a point near the end facing the tab contact and must have sufficient resilience to maintain a reliable connection.

Receptacle contacts having such a spring-loaded contacting arm are equipped with lugs extending inside from the side walls which limit the downward movement of the spring-loaded contacting arm in order to prevent it from deformation if the tab contact is inserted at an angle with respect to the receptacle contact.

However, since the lugs in the receptacle contact of the conventional design described above are located only at one location along the length of the spring-loaded contacting arm near the contacting tip, the spring-loaded contacting arm can be deformed beyond the limits of elastic deformation if the inserted tab contact or other object generates a sufficient force applied to the contacting arm in a position other than the location of the lugs.

SUMMARY OF THE INVENTION

This invention was made taking into account the above mentioned conditions, and one of its objects is to offer a receptacle contact of a design which would make it possible to prevent the deformation of the spring-loaded contacting arm described above.

The receptacle contact according to this invention has a spring-loaded contacting arm of a cantilevered configuration extending backward from the joining end, which is practically enclosed inside a box-like structure, and it is characterized by the fact that it has a protective structure enclosing the entire length of the spring-loaded contacting arm, except for its contacting section located near the free end of the spring-loaded contacting arm. The spring-loaded contacting arm is thus protected from damage by introduction of a mating male contact.

In addition, the receptacle contact according to this invention is characterized by the fact that it has, inside a box-like structure, a pair of overlapping inner and outer U-shaped portions extending from the front tab receiving end backwards, and that the free end of the inner U-shaped portion is bent to form a spring-loaded contacting arm, and the free end of the outer U-shaped portion is secured at both sides to the box-like structure, thus forming a protective structure for the spring-loaded contacting arm.

The receptacle contact according to this invention has a tab receiving cavity section in the form of a box-like structure whose purpose is to accommodate a mating tab contact therein. The tab receiving cavity has a spring-loaded contacting arm which forms a spring-loaded contact with the tab contact (male contact). The spring-loaded contacting arm consists of a resilient spring section extending lengthwise backward from the tab receiving cavity of the receptacle contact and a contacting section which forms contact with the mating tab contact. The spring-loaded contacting arm consists of a resilient spring section extending lengthwise backward from the tab receiving cavity of the receptacle contact and a contacting section which forms contact with the mating tab contact.

The receptacle contact according to this invention has a protective wall covering the spring-loaded arm from the tab receiving cavity section to the contacting section. There is a gap between the protective wall and the spring-loaded arm. It is preferable that the end of the protective wall is supported by side walls of the tab receiving cavity.

When a mating tab contact is not inserted straight, or if some other object is inserted in the receptacle connector, it will abut the protective wall without interfering with the spring-loaded contact arm.

BRIEF DESCRIPTION OF THE DRAWINGS

The preferred embodiment will now be described by way of example with reference to the accompanying drawing, whereby.

DETAILED DESCRIPTION

Figure 1:
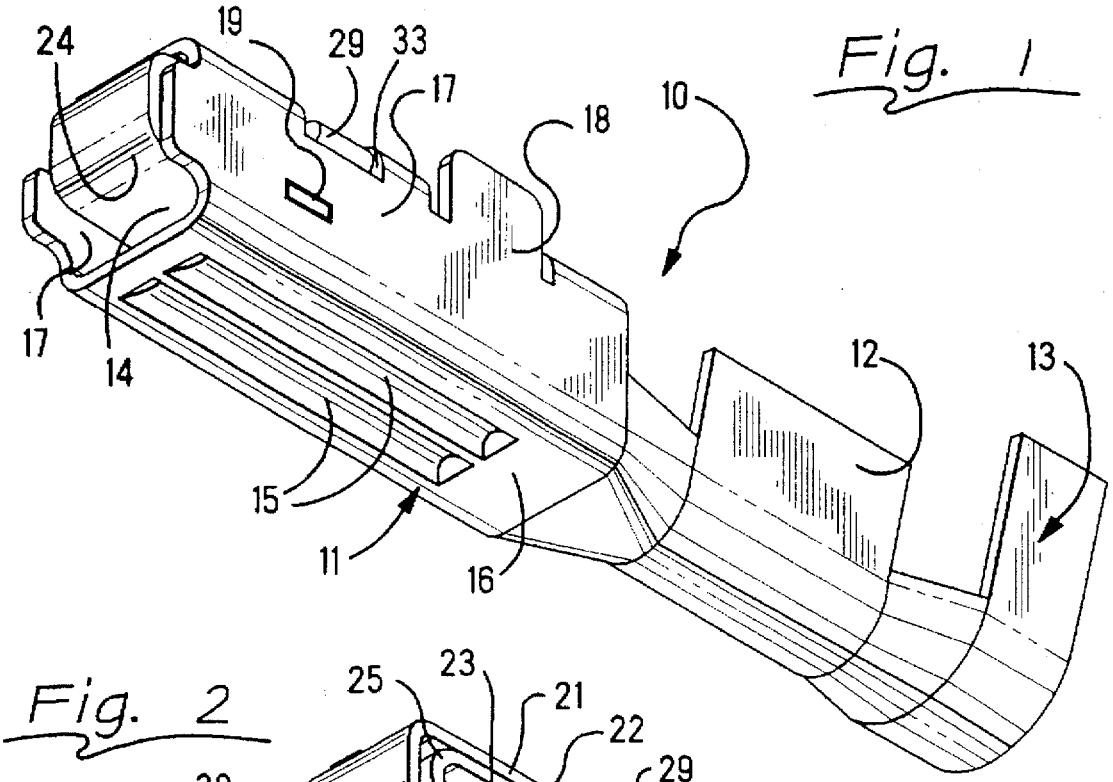
FIG. 1 is an isometric view from the bottom of an embodiment of a receptacle contact according to this invention.

FIG. 1 represents an overall isometric view of a receptacle contact 10 according to this invention. The receptacle contact 10 is stamped from a single metal sheet and bent to the configuration shown in FIG. 1 as a single piece. The receptacle contact 10 has a tab receiving cavity section 11 for receiving a tab contact, a conductor connection section 12 which is a crimping barrel in this embodiment but could be any other known wire connection means and is used for the connection of a conducting wire thereto, and a sleeve retaining section 13 used for securing the conducting wire.

As shown in FIG. 1, the tab receiving cavity section 11 of the receptacle contact 10 has a box-like configuration, and has a tab-insertion path 14 for the insertion of a mating tab contact. The tab-insertion path 14 is formed by a bottom wall 16, side walls 17 and by a protective wall 24. On the bottom wall 16, two embossed ribs 15 extend in the lengthwise direction of the path. The side walls 17 have a pair of guiding shoulders 18 extending upwardly therefrom.

Figure 2:
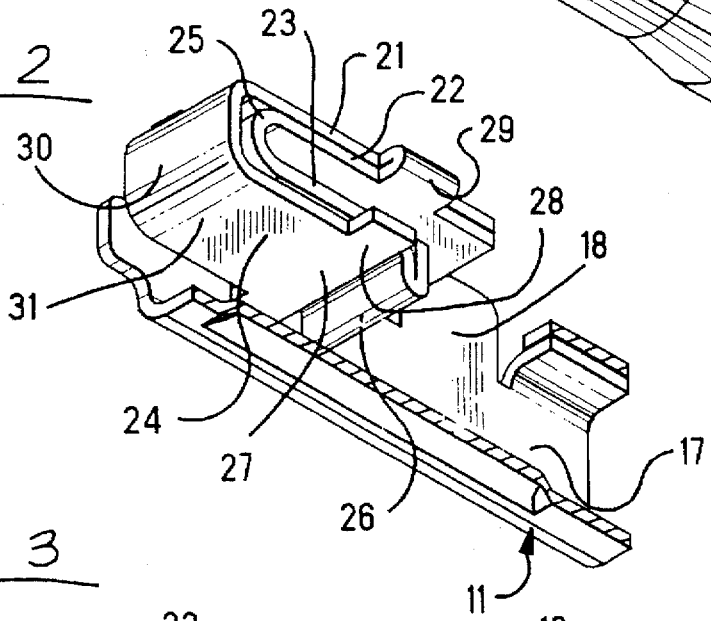
FIG. 2 is a partial cross-sectional view of the tab receiving cavity of the receptacle contact shown in FIG. 1.
Figure 3:
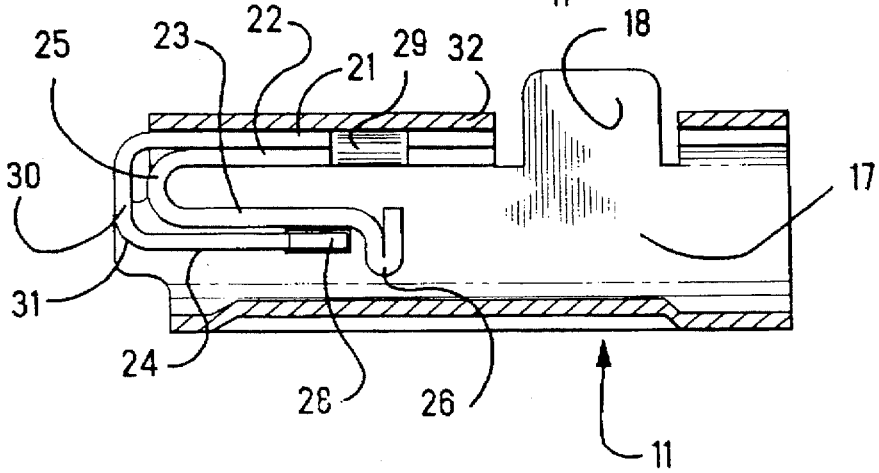
FIG. 3 is a partial cross-sectional view of the tab cavity of the receptacle contact shown in the FIG. 2.

As can be seen from FIGS. 2 and 3, the receptacle contact 10 has a first base wall 21 formed by bending at a right angle from a first side wall 17 (on one side) to extend toward the opposed second side wall 17 to a free side edge, and a second base wall 22 which is virtually in contact with the inner side of the first base wall. The first base wall 21 and the second base wall 22 are connected by a connecting piece 29 bent from the same metal sheet, with the connecting piece being folded over and extending from the free side edge of the first base wall 21 adjacent the second side wall 17.

The receptacle contact 10 also has a spring-loaded contacting arm 23 which is bent into a U-shaped configuration from the second base wall 22 into the tab receiving cavity and extends in the direction of the wire connection section 12. A protective wall 24 is bent from the loading end of the first base wall 21 initially toward the bottom wall 16 and then around the spring-loaded contacting arm 23 so that it envelops the spring-loaded contacting arm 23 and encloses it partially off from the side of the tab receiving cavity.

The spring-loaded contacting arm 23 consists of a spring section 25 and contacting section 26 which forms an electrical connection with the mating tab contact. As can be seen from FIG. 3, a space is provided between the spring-loaded contacting arm 23 and the protective wall 24 so that the spring section 25 can bend during the insertion of the tab contact.

The protective wall 24 extends along the spring-loaded contacting arm 23 toward the conductor connection section 26. At the end 27 of the protective wall 24, supporting lugs 28 are provided which extend to the side walls. The supporting lugs 28 are secured in the openings 19 made in the side walls 17 (see FIG. 1).

A guiding surface 31 is provided at the bent end 30 of the protective wall 24 in order to guarantee a smooth insertion of a mating tab contact. The guiding surface 31 depicted in FIG. 3 is curved, but it also may be made in the form of an inclined surface. The upper corner of the bent end 30 is also made in the form of a curved or inclined surface in order to provide for a smooth insertion of the receptacle contact 10 into a housing (not shown in the drawing).

As can be seen from FIG. 3, on the top of the first base wall 21, there is a cover wall 32 which is also formed by bending an extension of a second side wall 17 opposed from the first side wall, at a right angle. The cover wall 32 has an opening 33 into which the connecting section 29 linking together the first and second base walls 21 and 22 is inserted, thus increasing overall rigidity of the tab receiving cavity section 11.

Due to the fact that the side of the spring-loaded contacting arm 23 which faces the tab receiving cavity is completely, except for the contacting section 26, covered by the protective wall 24, the receptacle contact according to this invention is free from interference or contact between objects inserted in the tab-insertion path 14 and the spring-loaded contacting arm 23 except for the section 26 intended to form the electric contact. Therefore, no deformation of the spring-loaded contacting arm 23 exceeding the limit of elasticity takes place, thus resulting in highly reliable electric contacts. Contacts according to this invention make it possible to avoid damage thereto in the process of assembly of connectors or manufacturing of an automotive harness. First base wall 21, protective wall 24, second base wall 22 and U-shaped spring-loaded contacting arm or spring 23 together can be considered a first wall section, while bottom wall 16 and side walls 17 can be considered a second wall section surrounding the contact receiving cavity. It is seen that the lugs 28 are an embodiment of locking end section for protective wall 24 in cooperation with the openings 19 in the side walls comprising a locking section preventing movement of the protective wall end and thus protecting the spring.

In addition, the receptacle contact according to this invention is cost-effective due to the fact that it is made from a single piece of a sheet metal by means of relatively easy operations.

I claim:

1. A receptacle contact having a conductor connection section and a tab receiving cavity section formed by a bottom wall, opposed first and second side walls extending upwardly therefrom, a first base wall extending from said first side wall toward said second side wall to a free edge and being opposed to said bottom wall, and a spring-loaded contact arm having a contacting section for contacting a mating tab contact inserted into the tab receiving cavity section, the spring loaded contact arm having a U-shaped spring section proximate a tab receiving end of the receptacle contact, the spring section providing resiliency to the contact arm, protective wall extending from a leading end of said first base wall initially toward said bottom wall and then around the spring section of the spring-loaded contact arm to an end which is proximate the contacting section of the spring-loaded contact arm, to protect the contact arm from abutment or contact with the mating tab except at the contact section, said spring-loaded contact arm being joined to said free side edge of said first base wall by a folded-over connecting piece adjacent said second side wall, and a cover wall extending from said second side wall overlapping said first base wall, and an opening is provided in the cover wall to receive said connecting piece therein to increase the rigidity of the contact.

2. The receptacle contact of claim 1 wherein the protective wall extends substantially orthogonal from said first side wall.

3. The receptacle contact of claim 2 wherein the contact arm extends from the connecting piece towards a tab receiving end of the receptacle, fold over in a U-shaped spring section and extends towards the conductor connection section to the contacting section.

4. The receptacle contact of claim 3 wherein the protective wall extends in a U-shape around the U-shape of the spring-loaded contact arm, and therefrom to its end proximate the contacting portion.

5. The receptacle contact of claim 1 wherein the end of the protective wall comprises supporting lugs that are received in openings in the side walls to maintain the protective wall in position.

6. A receptacle contact comprising:

a conductor connection section for connection to an electrical conductor; and a contact receiving cavity section formed by a bottom wall, side walls, and a spring loaded contact arm extending from one of the side walls and having a U-shaped first base wall extending opposite said bottom wall to an end, a second base wall extending along and within said first base wall and including U-shaped spring section and a contact-contacting section with said spring section disposed within said U-shaped first base wall and said contact-contacting section protruding outwardly beyond said end toward said bottom wall, whereby said first base wall protects the spring-loaded contact arm from engagement with a mating contact member except at the contact-contacting section, and the end of the first base wall includes supporting lugs disposed in openings in the side walls.

7. A receptacle contact as claimed in claim 6, wherein a cover wall extending from the other of the side walls overlaps the first and second base wall.

8. An electrical contact comprising:

(a) a cavity having a contact receiving area and first and second wall sections;

(b) said first wall section comprises a first base wall layer and a second base wall layer;

(c) said second base wall layer comprises a spring for contact with a mating contact;

(d) said first base wall layer comprises an intermediate bend section for protecting said second base wall layer spring, and said first base wall layer has at least one locking end section; and (e) said second wall section comprises a locking section, said locking section cooperates with said first base wall locking end section, locking said locking end section and said first base wall section together, thereby inhibiting movement of said locking end section, for protecting said second base wall spring from said mating contact.

9. The electrical contact of claim 8, wherein said locking end section projects into said second base wall locking section.

10. The electrical contact of claim 8, wherein said locking end section comprises a lug for cooperating with said locking section.

11. The electrical contact of claim 8, wherein said first and second base wall layers comprise a connecting piece which connects them together, said connecting piece is disposed in an opening of said second wall section.

* * * * *